US005360629A

United States Patent [19]

Milbourn et al.

[11] Patent Number: 5,360,629

[45] Date of Patent: Nov. 1, 1994

[54] METHOD OF APPLYING DISCRETE COATING PATCHES ON A MOVING WEB

[75] Inventors: Thomas M. Milbourn, Mahtomedi; Jerry J. Barth, Red Wing, both of Minn.

[73] Assignee: Minnesota Mining and Manufacturing Company, St. Paul, Minn.

[21] Appl. No.: 44,150

[22] Filed: Apr. 7, 1993

Related U.S. Application Data

[63] Continuation-in-part of Ser. No. 786,751, Nov. 1, 1991, abandoned.

[51] Int. Cl.[5] ..... B05D 1/26

[52] U.S. Cl. ..... 427/8; 427/288; 427/420; 118/410; 118/411; 118/419

[58] Field of Search ..... 427/420, 8, 288; 118/410, 419, 411

[56] References Cited

U.S. PATENT DOCUMENTS

| | | | |
|---|---|---|---|
| 3,420,208 | 1/1969 | Guthrie | 118/411 |
| 3,595,204 | 7/1971 | McIntyre et al. | 118/8 |
| 3,896,722 | 7/1975 | Farrow | 118/411 |
| 3,973,961 | 8/1976 | Stroszynski | 96/1.5 |
| 4,050,410 | 9/1977 | Stroszynski | 118/410 |
| 4,565,217 | 1/1986 | McIntyre | 137/625.5 |
| 4,572,103 | 2/1986 | Engel | 118/697 |
| 4,729,858 | 3/1988 | Chino et al. | 264/37 |
| 4,831,961 | 5/1989 | Chino et al. | 118/410 |
| 4,938,994 | 7/1990 | Choinski | 427/96 |

FOREIGN PATENT DOCUMENTS

| | | |
|---|---|---|
| 0505894A1 | 9/1992 | European Pat. Off. . |
| 3542903C2 | 8/1991 | Germany . |

OTHER PUBLICATIONS

Brochure: "INCA-2000 Patch Coater", 1990, (no month date).

*Primary Examiner*—Shrive Beck
*Assistant Examiner*—Katherine A. Bareford
*Attorney, Agent, or Firm*—Gary L. Griswold; Walter N. Kirn; Charles D. Levine

[57] ABSTRACT

An apparatus for coating a pattern of spaced discrete patches on a web of material includes an extrusion die and a metering pump which supplies coating fluid to the extrusion die from a fluid reservoir. A valve directs fluid to either the extrusion die or the fluid reservoir and a piston provides a controlled excess of flow of fluid to the extrusion die. A controller, including a digital preset counter, controls the length of the coated portions of the web, the distance between the coated portions of the web, and the timing of the valve with respect to the operation of the piston.

13 Claims, 1 Drawing Sheet

METHOD OF APPLYING DISCRETE COATING PATCHES ON A MOVING WEB

This is a continuation-in-part application of U.S. application Ser. No. 07/786,751, filed Nov. 1, 1991, now abandoned.

TECHNICAL FIELD

The present invention relates to coating apparatus. More particularly, the present invention relates to coating apparatus which can be used to coat spaced portions of a substrate.

BACKGROUND OF THE INVENTION

Coating a fluid onto a web of material is well known. It is also known to coat a fluid onto a web in a series of discrete patches. In one system, a gravure coating process using a roll coater can be used. However, while this produces clean front and rear patch edges, the cell pattern is visible in the overall appearance, causing the patch to be optically unclear which is undesirable. Also, applying more than one type of fluid (i.e., different colors) to specific areas on a moving web requires a series of gravure coating stations with drying ovens after each coating. The repeat pattern on the gravure roll determines the location of each patch and the fluids are typically applied by a coat/dry, coat/dry, . . . , coat/dry process. The overall repeat length of a patch series is limited and set by the circumference of the gravure cylinders. Patch sizes cannot be changed except by changing the gravure cylinders.

In U.S. Pat. Nos. 3,973,961 and 4,050,410, photoconductor patches are coated onto carrier webs. A main pump provides the major supply of fluid to the die and recycle line. Excess flow is supplied to the die to obtain transversely uniform flow of fluid through the die to the web. Two dosing pumps, one upstream and the other downstream of the die, complement the main pump by adding controlled oversupply and retraction of fluid in the die for starts and stops, respectively, of the coating process. However, with this system, nonuniform light areas of coating occur on the front and back portions of the coated patch. Moreover, the coating weight increases over the front portion of the patch before decreasing toward the back portion of the patch. Also, the front and rear edges are not straight, but are convexly curved and require 2–10 mm to start and 30 mm to stop. These unacceptable variations require additional complex control equipment.

U.S. Pat. No. 4,938,994 to Choinski and a related promotional brochure entitled "Inca - 2000 Patch Coater" disclose an apparatus for patch coating a plurality of incremental printed circuit boards. During operation, the coating fluid is fed through applicator lips without continuously circulating. A single patch is coated onto a single incremental board. There is no disclosure to coat a plurality of patches on a moving web. Because the Choinski system does not coat a plurality of patches on a single board or substrate, Choinski is not concerned with coating edge sharpness because imprecise coating location does not significantly adversely affect the final product.

Moreover, a positioning piston moves the die toward and away from the board to coat and to assist in breaking the coating bead. This will not work adequately at high speeds. The Choinski system can not coat at speeds as fast as one patch per second due to the mechanical operations of moving the die and the lip seal, due to the starting and stopping of the feed pump, and due to the need for large spacing between coatings to permit cleaning and die movement. The board speed ranges from 0.30–7.62 m/min (1–25 ft/min).

Furthermore, in Choinski, the piston is inside of the die which can create shocks and cause coating defects. The piston is a flow obstruction which disrupts the coating fluid flow in the die, making a nonuniform flow distribution across the die width and leading to nonuniform coating such as streaking or banding. Also, the Choinski die is positioned perpendicular to the horizontal coating substrates. The die is oriented vertically with the die lips pointing down toward the web surface. This can lead to two problems. Air bubbles tend to accumulate in the die manifold leading to nonuniform coating and degraded patch formation due to the increased effective compressibility of the system (damping). With lower viscosity fluids, it is more likely for the coating liquid to dribble from the coater die lips onto the web between patches, requiring a lip seal. Also, as Choinski coats discrete circuit boards, there is no product beneath the die between coatings, to be ruined by dribble.

U.S. Pat. Nos. 4,729,858 and 4,831,961, to Chino et al. disclose applying a magnetic coating to a moving web. A valve helps to recirculate the coating fluid back to a reservoir when the coater stops. Recirculation occurs at the end of coating and ceases during resumption of coating after the passage of a joint between two connected webs. The valve, apparently a standard pneumatic valve, starts and stops the coater and requires about 0.5–2.0 seconds to move. Chino does not suggest coating a plurality of patches or recirculating fluid between the coating of patches.

Mcintyre, U.S. Pat. No. 3,595,204 discloses a coating apparatus that coats very thick and viscous coatings such as hot melt adhesives. This apparatus coats at thicknesses on the order of several millimeters (hundreds of mils).

U.S. Pat. Nos. 3,973,961 and 4,050,410 to Stroszynski disclose a coating apparatus which can provide relatively sharp starts of coating on the web but cannot coat sharp stops. The ends of the coatings are curved and can not be made straight. Also, the recirculation system of this apparatus recirculates fluid through the coating die, slowing the coating process.

SUMMARY OF THE INVENTION

The present invention overcomes the common nonuniformity problems of known coating systems and coats a pattern of plural precisely formed and spaced discrete coating patches on a single web that moves past the die at speeds of over 10 m/min. The invention can coat up to 100 or more patches per second. The apparatus includes an extrusion die, a metering pump which supplies coating fluid to the extrusion die from a fluid reservoir, and a three-way valve which directs fluid to either the extrusion die or the fluid reservoir. The coating fluid is continuously transported from the reservoir to the valve which directs coating fluid to the die when patches are being coated and to the reservoir when patches are not coated.

A piston, separate from the die, moves toward the fluid to force the fluid toward and through the die to provide a controlled excess flow of coating fluid to the extrusion die. This provides clean front edges of coating patches by quickly beginning the application of coating onto the web. The piston moves away from the fluid to pull fluid into the piston cylinder and suck fluid backward into the die to provide a sharp break at the coating bead to provide clean rear edges of the coating patch. The extrusion of coating fluid onto the web occurs while maintaining a constant distance between the coating die and the web.

A controller controls the operation of the valve and the piston to control the length of and the distance between the coated portions, and to coordinate the valve timing with respect to the piston operation. The controller includes a start counter which regulates the beginning of coating and an end counter which regulates the ending of coating. Each counter is adjustable to independently regulate the operation of the valve and the piston. The controller can cause the movement of the piston to precede, follow, or occur simultaneously with the switching of the valve. The relative timing of operation between the valve and the piston is selected in combination with the various properties and conditions of coating.

DETAILED DESCRIPTION OF PREFERRED EMBODIMENTS

Figure 1:
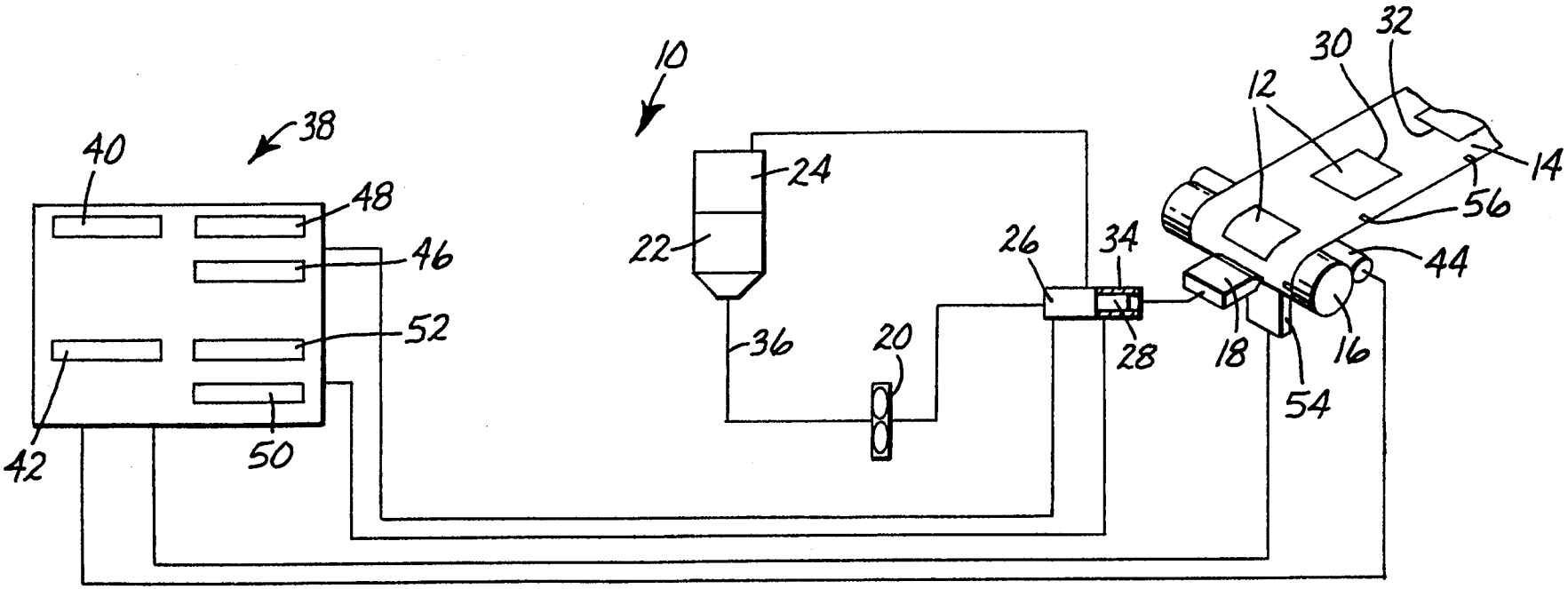
FIG. 1 is a schematic view of the coating apparatus according to the present invention.

The coating apparatus 10 and method coats a pattern of a plurality of spaced discrete coating patches 12 on a single web 14 of material as the web 14 passes around a backup roller 16. The apparatus 10 and method also can be used to coat a plurality of discrete elements whether mounted on a flexible web or freely sitting on a conveyor.

The apparatus 10 includes an extrusion die 18 capable of producing uniform coatings having a thickness of 0.0025 cm (0.001 in) or less, as well as thicker coatings. Known extrusion dies, such as the Ultracoat and Magnacoat models made by Extrusion Dies Inc. of Chippewa Falls, Wis., meeting this requirement can be used. A gear type metering pump 20 accurately supplies coating fluid 22 to the extrusion die 18 from a fluid reservoir 24. Alternatively, the coating fluid could be delivered by any other pressure feed system. A pneumatic valve, such as an air-operated three-way, high speed spool valve 26 directs fluid 22 to either the extrusion die 18 or the reservoir 24. Spool valves do not displace the coating when the spool shuttles back and forth. An air-operated piston 28 displaces the coating without any displacement caused by the spool valve 26. Alternatively, the piston 28 or valve 26 can be operated mechanically, electrically, or hydraulically. Fluid 22 is constantly pumped from the reservoir 24 through the spool valve 26. In one position of the valve 26, the fluid 22 passes to the extrusion die 18 to coat patches 12 on the web 14. In the other valve position, the fluid 22 returns to the reservoir 24.

Clean, sharp front edges 30 and rear edges 32 of the coating patches 12 are produced by quickly establishing and ending the coating bead of the fluid 22. Sharp edges are defined as being substantially straight, substantially parallel to the die lip, and substantially perpendicular to the web direction. This is accomplished by cooperatively operating the valve 26 and the piston 28. When coating of the web 14 is to begin, the valve 26 causes fluid 22 to proceed to the extrusion die 18, which already is full of fluid 22, while the piston 28 moves within its cylinder 34 toward the fluid 22 in the coating line 36 to force the fluid 22 toward and through the extrusion die 18 to provide a controlled excess flow of fluid 22 to the extrusion die 18. The fluid 22 is simultaneously distributed across the full width of the die 18 to bridge the coating gap. With this apparatus 10 and method, coating has been performed at speeds of up to 152.4 m/min (500 ft/min) and clean, sharp front and rear edges 30, 32 have been attained at speeds of 109.7 m/min (360 ft/min). After coating has begun, the fluid 22 is extruded onto the web 14 at a lower constant rate as determined by the metering pump 20. The amount of coating applied per coating patch 12 can be adjusted by adjusting the volume displaced by the pump 20.

When the coating of the web patch 12 is to end, the valve 26 causes fluid 22 to proceed back to the reservoir 24 while the piston 28 moves within its cylinder 34 away from the fluid 22 in the coating line 36. This pulls fluid 22 into the piston cylinder 34, sucks fluid 22 back into the die 18, and provides a sharp break in the fluid 22 flowing from the extrusion die 18. As discussed below, the relative timing of the piston 28 and the valve 26 are coordinated and need not be simultaneous.

A controller 38 is assembled from a plurality of known electrical subcomponents to form an electronic control package. The controller 38 controls the operation and coordinates the timing of the valve 26 and the piston 28 to control the length of the coated patches 12 and the distance between the coated patches 12 on the web 14 within the limits set by the timing marks 56 discussed below. The movement of the piston 28 can precede, follow, or can operate simultaneously with the opening or closing of the valve 26. This enables the sharp, precise, uniform front and rear edges 30, 32 of the coating patches 12 to be fine tuned. Time variations between the operation of the valve 26 and piston 28 typically are on the order of milliseconds. Additionally, the piston stroke can be varied to change the effective volume of fluid 22. This can further enhance adjustment of the sharp front and rear edges 30, 32 of the coating patches 12 by accommodating different coating parameters such as viscosity, web speed, and coating thickness.

The controller 38 includes two high speed counters 40, 42 and an encoder 44. The counters 40, 42 regulate the beginning and ending of the coating of fluid 22 onto the web 14 to form the coating patch 12. The start counter 40 regulates the beginning of coating while the end counter 42 regulates the ending of coating. The start counter 40 has two adjustable settings 46, 48 which are dimensionless numbers and are manually adjusted, as by a dial or thumbwheels, to govern the beginning operation of the valve and the piston, respectively. The end counter 42 has two adjustable settings 50, 52 which are dimensionless numbers and are manually adjusted, as by a dial or thumbwheels, to govern the ending operation of the valve and the piston, respectively. One setting 46, 50 regulates the timing of the valve 26 and the other setting 48, 52 regulates the timing of the piston 28. If both settings 46, 48 or 50, 52 on one counter are set at the same number the valve 26 and piston 28 act simultaneously. If one setting is set at a lower number, the respective valve 26 or piston 28 acts first. These settings and piston displacements are selected in combination with the various properties and conditions of coating including the fluid rheology, the web material and coating thickness, and the web speed.

The encoder 44 is driven by the web movement around either the backup roller 16 or a nip roller. The encoder 44 sends a predetermined set number of pulses per unit length of web 14 travel (which can be backup roller 16 rotation) to the counters 40, 42 to coordinate the coating patch 12 application. A fiberoptic sensor 54 reads timing marks 56 on the web 14. When a timing mark 56 is encountered, the sensor 54 signals the start counter 40 and end counter 42 to begin counting simultaneously. When the start counter 40 reaches the preset number for the valve 26, the valve 26 diverts fluid 22 to the extrusion die 18. When the preset start number for the piston 28 is reached the piston 28 moves within the cylinder 34 toward the fluid 22 to provide a controlled excess flow, of fluid 22 to the die 18 to quickly begin coating and provide a sharp front edge.

The length of the coating patch 12 on the web 14 is determined by the preset numbers on the end counter dials 42 in conjunction with the preset numbers on the start counter dials 40. When the end counter 42 reaches the preset number for the valve 26, the valve 26 diverts fluid 22 back to the reservoir 24. When the preset end number for the piston 28 is reached the piston 28 moves within its cylinder 34 away from the fluid 22 to pull the fluid 22 into the cylinder 34 to cause a quick cessation of fluid 22 out of the die 18 and provide a sharp rear edge. After coating stops, the counters 40, 42 are reset to zero in preparation for coating the next patch 12. The beginning of the next patch 12 can be triggered by another timing mark 56 on the web 14, by previously coated patches 12, or by other systems. Thus, the spacing between or overlap of adjacent patches 12 can be accurately and precisely controlled.

This apparatus 10 produces highly uniform coating patches 12 in varying lengths. The width of the patches 12 depends on the coating die 18 width. A single die 18 with removable shims can vary the coating patch 12 width. A plurality of apparatus 10, each coating with different fluids 22, such as different colored fluids, can coat alternating patches 12 of different color on the web 14 without oven drying between the patches. Typically, patches 12 of yellow, magenta, cyan, and black are used on webs 14 of 6 micron thick polyethylene teraphthalate.

A method of coating a pattern of a plurality of spaced coating patches 12 on a single web of material 14 includes the following steps. First, relative movement between the web of material and a coating die at speeds of at least 10 m/min is provided, preferably by moving the web 14 relative to the die 18. Next, the coating fluid 22 is pumped from the reservoir 24 to the spool valve 26. The valve 26 directs fluid 22 to either the extrusion die 18 or the fluid reservoir 24. The fluid is pumped to the die 18 at intervals corresponding to when coating is desired. A pulsed flow of fluid 22 is provided to the extrusion die 18 from the valve 26 using the piston 28. A controlled excess flow of coating fluid is provided to the die 18 to provide sharp front edges of the coating patches to quickly establish the coating bead while maintaining a constant distance between the coating die and the web. A sharp break in the coating fluid flowing to the extrusion die is provided to provide sharp rear edges of the coating patches to quickly end the coating bead while maintaining a constant distance between the coating die and the web.

The valve 26 and piston 28 are driven at high speed using 300 psi nitrogen directed to two pneumatic cylinders which are coupled directly to the valve and the piston. The nitrogen is directed by two double solenoid valves which are spool type valves powered by 24 volt DC coils. 80–90 volts are supplied to the valves to increase their speed and repeatability. As the solenoid valve spool shifts back and forth, the nitrogen is supplied to either side of the pneumatic cylinders, which then opens or closes the valve 26 and shifts the piston 28.

Next, the coating fluid is extruded onto the web while maintaining a constant distance between the coating die and the web. The providing a controlled excess flow, providing a sharp break, and extruding steps are performed without obstructing the flow within the die. Thus, the piston is separate from the die. The length of and distance between the coated patches on the web are controlled and the timing of the directing step with respect to the operation of the two providing steps are coordinated.

The method can also include selecting the relative timing of operation between the directing step and the two providing steps in combination with the various properties and conditions of coating. The controlling and coordinating steps can include electronically controlling and coordinating without contacting the web with mechanical switches.

This system has many advantages over the known roll coating method of coating patches on a web. The apparatus 10 is a closed system and is not subject to atmospheric interferences. Solvents with drying or evaporation problems when used in open pan systems can be used with the apparatus 10 more reliably and easily. As the apparatus 10 uses a noncontact die 18, there is less chance of upsets in or breaking of the web than contact systems. Over the long term, patch characteristics within individual patches and from patch to patch and web to web are more uniform as there is no wear from doctor blades. The apparatus 10 also can change patch lengths easily without storing and changing many rolls. Moreover, changing the patch length can be accomplished simultaneously. By using a multiple slot die multiple layers can be coated simultaneously. Additionally, changing the patch length, patch width, and patch position relative to other patches are very easy.

This system can coat patches in 10 millisecond to 1 second and greater. This is equivalent to coating up to 100 or more patches per second. This is much faster than known coating systems. For example, the Choinski system is not capable of making more than one patch per second due to the mechanical operations of moving the die and the lip seal, and the need for large spacing between coatings to permit cleaning, and die movement. This is also much faster than the Chino system which uses a three-way valve which is not intended to make patches. The Chino three-way valve functions to start and stop the machine after hours of run time and movement of this valve alone would take 0.5–2.0 seconds. Chino uses a fluid bearing die which can not pulse a coating onto a web and is not capable of making patches more than once per second.

Moreover, moving the die toward and away from the substrate to coat and assist in breaking the coating bead as in Choinski does not provide sharp front or rear edges of the coating patches to quickly establish the coating bead and to quickly end the coating bead. Moving the die does not permit the extrusion of coating fluid onto the web to occur while maintaining a constant distance between the coating die and the web.

The hardware is limited by the time to physically move the piston and spool valve. The time to move the spool valve has been measured at about 4 milliseconds (ms) from the time the spool begins to move to the time it has finished its one-way stroke. This lag, as long as it is repeatable, can be accounted for in the piston and valve control scheme. The piston movement time is about 2 ms. The counters can handle about 30,000 counts per second and faster counters are available commercially. The rotopulser of the controller 38 encodes off of the web and can encode 2500 counts per foot of web. The number of counts per foot can be adjusted by changing the drive ratio of the rotopulser to the web or by using a higher count per revolution rotopulser (which are commercially available). At 122 m/min (400 ft/min) web speed, there are 16.7 counts/ms, 66.7 counts in the time it takes the valve to actuate. This is much more time resolution than the physical motion of the valve.

One set-up requires about 4 ms to start the patch and about 4 ms to stop the patch, limited by the valve movement. Therefore, if the patch coat time is about 2 ms, patches can be produced in 10 ms. (Moving the piston and valve faster than the 4 ms could be obtained by increasing the nitrogen pressure to actuate the pneumatics, improving the piston pneumatic design, or using a hydraulic drive system, a direct electronic motor, or a solenoid drive.) A 10 ms/patch time yields 100 patch/-sec.

The coated patches, even when coated at high frequencies, meet stringent requirements for control of length and registration. Patch length is currently held within 0.0794 cm (0.0312 inch) and registration within 0.1588 cm (0.0625 inch). Thus, the distance, in the direction of web travel, from the first point of contact of fluid on the web to the first point of cross-web uniform patch coating is less than 10 mm, and the distance, in the direction of web travel, from the last point of cross-web uniform patch coating to the last point of contact of fluid on the web is less than 10 mm. These accuracies can be improved with further development but can not be achieved by the Choinski, Chino, or Straszynski systems.

With the apparatus 10 and method of the present invention, multiple patches of different fluids can be applied at one coating station and the group of patches can be dried at the same time in a single oven with a coat, coat, . . . ,coat, dry process. This can be accomplished by mounting several coater die heads around one or more backup rolls, or using any apparatus that does not have face side contact to the coated web or by using one or more extrusion dies with multiple fluid feed slots in each die to coat distinct coating liquids from each of the separate slots. This provides significant advantages over the current gravure process. Additionally, an extrusion die with multiple fluid feed slots can be used to coat multiple layer patches.

Since there is only one coating station and one oven, the web path through the coating machine is much shorter than the conventional tandem methods. The shorter web path means substantially higher yields of product from this method. One coating station and one oven also requires a much lower investment in capital and operational costs compared to the multiple stations and ovens for conventional methods. Finally, the multiple gravure method exposes the first patch to multiple drying passes and the last patch to only one drying pass. For example, in a four patch system, the first patch would go through four ovens, the second patch through three ovens, the third patch through two ovens and the last patch through one oven. This added thermal history can degrade product performance on the first three patches. With the present system, all of the patches see the same thermal history with resultant product performance improvements.

The system of the present invention also offers much greater flexibility than the current gravure coating systems because the patch length and patch group can be instantly adjusted using the control electronics instead of physically modifying equipment. The individual patch length is adjusted by changing the count at which the patch starts or stops. For multiple patch coating, any permutation of the distinct coating liquids from each coating head can be coated. For example, a four head coating station with coating liquids A, B, C, and D, could coat patch groups of AAAA, ABCD, DCBA, DDCC, ABC, A, or ABADCD. The order of coating of the patches onto the web need not be the order in which they appear on the finished coated patch group.

The target coating thickness range for the apparatus 10 and its method is generally less than 0.0025 cm (1.0 mil) although thicker wet layers can be coated. A thin wet layer with precision control of wet layer thickness is coated. Also, the apparatus 10 and its method can coat at the levels described above, improving coating speed, uniformity, and performance, using low viscosity fluids. Low viscosity fluids, for the purposes of this invention are fluids having a viscosity of less than 10,000 cps at temperatures of 15° C. to 30° C.

The piston is separate from the coater die because the apparatus 10 and method make precision coatings of coating liquids which are susceptible to shock/vibrational disturbances causing coating nonuniformity defects. Removing the piston from the die removes the piston as a shock source which could cause coating defects and as a flow obstruction which disrupts the coating fluid flow in the die, makes a nonuniform flow distribution across the die width, and leads to nonuniform coating such as streaking or banding.

To avoid the problems associated with positioning the die normal to the horizontal coating substrates (as in Choinski) the dies are mounted around a backup roll below the horizontal centerline of the backup roll. Other angles, such as those above the horizontal centerline of the backup roll, can be used but can result in ancillary defects. In this arrangement, air bubbles tend to purge themselves naturally rather than requiring bleed valves as in a vertical die. Also, with lower viscosity fluids, it is less likely for the coating liquid to dribble from the coater die lips onto the web between patches and destroy large quantities of web product.

We claim:

1. A method of coating a pattern of a plurality of spaced discrete coating patches on a single web of material, wherein each patch has a length and a width, comprising the steps of:

providing relative movement between the web of material and a coating die, wherein the coating die has a width, at speeds of at least 10 m/min;

delivering coating fluid from a reservoir to the die at intervals corresponding to when coating is desired;

directing coating fluid to either the die or the reservoir depending on whether coating is desired;

providing, at the start of each patch, a controlled excess flow of coating fluid to the die to provide sharp, linear front edges of the coating patches to quickly establish the coating fluid flow from the die while maintaining a constant distance between the coating die and the web;

providing a sharp break in the coating fluid flowing from the die to provide sharp, linear rear edges of the coating patches to quickly end the coating fluid flow from the die while maintaining a constant distance between the coating die and the web;

extruding coating fluid onto the web at a nonexcess flow after the start of the patch while maintaining a constant distance between the coating die and the web, wherein the providing a controlled excess flow, providing a sharp break, and extruding coating steps are performed without obstructing the flow within the die and are performed to create uniform coating patches;

controlling length of and distance between the coated patches on the web; and coordinating timing of the directing step with respect to the operation of the two providing steps.

2. The method of claim 1 further comprising the step of selecting the timing of operation between the directing step and the two providing steps in combination with properties of the coating fluid and conditions of coating.

3. The method of claim 2 wherein the step of providing a controlled excess flow comprises pumping the fluid using a piston having a stroke length, the step of providing a sharp break comprises pumping the fluid using a piston, and further comprising the step of adjusting the stroke length of the piston to correspond to the properties of the coating fluid and the conditions of coating, wherein the stroke length of the piston is independent of the amount of coating applied or the length of the patches.

4. The method of claim 1 further comprising repeating all of the steps for each patch coated on the web.

5. The method of claim 4 wherein patches of different fluids are coated on the web and further comprising the step of drying the coated patches once after a plurality of different-fluid patches are coated on the web.

6. The method of claim 1 wherein the controlling and coordinating steps comprise electronically controlling and coordinating without contacting the web with mechanical switches.

7. The method of claim 1 wherein the providing step comprises moving the web relative to the die.

8. The method of claim 1 wherein the extruding coating fluid step comprises extruding coating fluid onto the web without contacting the web with the coating die.

9. The method of claim 1 wherein the step of providing a controlled excess flow comprises causing the distance, in the direction of web travel, from a first point of contact of fluid on the web to a first point of cross-web uniform patch coating is less than 10 mm, and the step of providing a sharp break comprises causing the distance, in the direction of web travel, from a last point of cross-web uniform patch coating to a last point of contact of fluid on the web is less than 10 mm.

10. The method of claim 1 further comprising the step of altering the width of the die to alter the width of the coated patches.

11. The method of claim 1 further comprising the step of mounting the die around a backup roll below the horizontal centerline of the backup roll.

12. A method of coating a pattern of a plurality of spaced discrete coating patches on a single web of material, wherein each patch has a length, comprising the steps of:

providing relative movement between the web of material and a coating die at speeds of at least 10 m/min;

delivering coating fluid from a reservoir to a die at intervals corresponding to when coating is desired;

directing coating fluid to either the die or the reservoir depending on whether coating is desired;

providing, at the start of each patch, a controlled excess flow of coating fluid to the die to provide sharp, linear front edges of the coating patches to quickly establish the coating fluid flow from the die while maintaining a constant distance between the coating die and the web;

providing a sharp break in the coating fluid flowing from the die to provide sharp, linear rear edges of the coating patches to quickly end the coating fluid flow from the die while maintaining a constant distance between the coating die and the web;

extruding coating fluid onto the web at a nonexcess flow after the start of the patch while maintaining a constant distance between the coating die and the web, wherein the providing a controlled excess flow, providing a sharp break, and extruding coating steps are performed without obstructing the flow within the die and are performed to create uniform coating patches;

controlling length of and distance between the coated patches on the web; and coordinating timing of the directing step with respect to the operation of the two providing steps to permit coating of up to 100 patches per second on the web.

13. A method of coating a pattern of a plurality of spaced discrete coating patches on a single web of material, wherein each patch has a length, comprising the steps of:

providing relative movement between the web of material and a coating die at speeds of at least 10 m/min;

delivering low viscosity coating fluid from a reservoir to an die at intervals corresponding to when coating is desired;

directing coating fluid to either the die or the reservoir depending on whether coating is desired;

providing, at the start of each patch, a controlled excess flow of coating fluid to the die to provide sharp, linear front edges of the coating patches to quickly establish the coating fluid flow from the die while maintaining a constant distance between the coating die and the web;

providing a sharp break in the coating fluid flowing from the die to provide sharp, linear rear edges of the coating patches to quickly end the coating fluid flow from the die while maintaining a constant distance between the coating die and the web;

extruding coating fluid onto the web at a nonexcess flow after the start of the patch while maintaining a constant distance between the coating die and the web, wherein the providing a controlled excess flow, providing a sharp break, and extruding coating steps are performed without obstructing the flow within the die and are performed to create uniform coating patches;

controlling length of and distance between the coated patches on the web; and coordinating timing of the directing step with respect to the operation of the two providing steps.

* * * * *